US006295673B1

(12) United States Patent
Mossbeck

(10) Patent No.: US 6,295,673 B1
(45) Date of Patent: Oct. 2, 2001

(54) REINFORCED POCKETED SPRING ASSEMBLY

(75) Inventor: Niels S. Mossbeck, Dayton, TN (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 09/207,441

(22) Filed: Dec. 8, 1998

Related U.S. Application Data

(60) Provisional application No. 60/094,135, filed on Jul. 24, 1998.

(51) Int. Cl.[7] ..... A47C 27/07

(52) U.S. Cl. ..... 5/655.8; 5/716; 5/720

(58) Field of Search ..... 5/230, 720, 655.8, 5/716, 655.7; 156/182, 563, 297, 301

(56) References Cited

U.S. PATENT DOCUMENTS

| | | | | |
|---|---|---|---|---|
| 2,296,807 | | 9/1942 | Cavaler | 5/353 |
| 2,862,214 | | 12/1958 | Thompson et al. | 5/353 |
| 3,633,228 | | 1/1972 | Zysman | 5/353 |
| 4,234,983 | | 11/1980 | Stumpf | 5/477 |
| 4,401,501 | | 8/1983 | Stumpf | 156/367 |
| 4,485,506 | | 12/1984 | Stumpf et al. | 5/477 |
| 4,566,926 | | 1/1986 | Stumpf | 156/165 |
| 4,578,834 | | 4/1986 | Stumpf | 5/477 |
| 4,854,023 | * | 8/1989 | Stumpf | 5/720 X |
| 4,907,309 | | 3/1990 | Breckle | 5/477 |
| 4,986,518 | * | 1/1991 | Stumpf | 5/720 X |
| 5,016,304 | | 5/1991 | Ryhiner | 5/453 |
| 5,016,305 | | 5/1991 | Suenens et al. | 5/477 |
| 5,126,004 | | 6/1992 | Suenens et al. | 156/556 |
| 5,127,635 | * | 7/1992 | Long et al. | 5/720 X |
| 5,319,815 | | 6/1994 | Stumpf et al. | 5/477 |
| 5,637,178 | | 6/1997 | Suenens et al. | 156/297 |
| 5,885,407 | | 3/1999 | Mossbeck . | |

FOREIGN PATENT DOCUMENTS

| | | |
|---|---|---|
| 4031652 | 4/1992 | (DE) . |
| 4040220 | 6/1992 | (DE) . |
| 9214732 | 7/1994 | (DE) . |
| 29902911 | 6/1999 | (DE) . |
| 0089789 | 9/1983 | (EP) . |
| 0357912 | 3/1990 | (EP) . |
| 0985369 | 3/2000 | (EP) . |
| 1475098 | 2/1967 | (FR) . |
| 2076465 | 10/1971 | (FR) . |

* cited by examiner

*Primary Examiner*—Terry Lee Melius
*Assistant Examiner*—Fredrick Conley
(74) *Attorney, Agent, or Firm*—Wood, Herron & Evans LLP

(57) ABSTRACT

A method of assembling strings of pocketed coil springs into an innerspring core which may be used as the core of a mattress, cushion or similar body support foundation uses a reinforcing material, preferably having an adhesive component, between rows of pocketed coil springs. The reinforcing, adhesive material serves to bond the rows of springs to each other and to reinforce the pockets to prevent wear between coils in frictional relation.

35 Claims, 3 Drawing Sheets

REINFORCED POCKETED SPRING ASSEMBLY

Pursuant to 37 C.F.R. § 1.78(a)(4), this application claims the benefit of and priority to prior filed co-pending Provisional Application Ser. No. 60/094,135, filed Jul. 24, 1998, which is expressly incorporated herein by reference.

FIELD OF THE INVENTION

This invention relates to reinforced pocketed spring assemblies for mattress cores and the like and to a method of assembling reinforced pocket coil spring assemblies.

BACKGROUND OF THE INVENTION

It is known to place strings of pocketed or encased coil springs in a parallel fashion to create a mattress, inner spring unit or other body support foundation. A known method for making the strings of encased coil springs is to fold the encasing or pocketing material such that there is a crease on one longitudinal side and an opening on the opposite side. Compressed coils are inserted through the opening between the layers of pocketing material and the opening is scaled by a sealing system, such as a thermal sealing system or stitching. The layers of pocketing material are further sealed between each coil. The coils are then turned and expanded such that one end of the coil is facing the crease of the pocketing material and the other end is facing the sealed opening.

The number of coils in a string or row and the number of rows are dependent upon the coil spring diameter and the desired finished size of the mattress or the like. The construction of the mattress core may include a plurality of rows of parallel coils with the coils aligned in columns so that the coils line up in both longitudinal and lateral directions, or they may be nested in a honeycomb configuration wherein coils in one row are off-set from coils in the adjacent row.

It is known to connect the strings of coils in a coil to coil manner by applying an adhesive to the encased coils as illustrated in Stumpf U.S. Pat. Nos. 4,566,926 and 4,578,834 5,016,305 and 5,637,178, each of which are hereby incorporated by reference. Nested constructions where strings of coils are interlocked are illustrated in Stumpf U.S. Pat. No. 5,319,815 and German 4,040,220, each of which are hereby incorporated by reference. Other methods of connecting the strings of coils utilize metal clips known as hog rings or they may be stitched with twine which penetrates each string of coils.

Another method in the prior art is the use of strings of coils positioned in a frame with a web of nonwoven material sprayed on the top and bottom of the pocketed coil units, the spray nozzles being manually controlled. Alternatively, or in addition, to the spraying method, beads of hot melt adhesive may be dispensed onto the top and bottom surfaces of the strings of coils and a sheet of nonwoven material pressed against the adhesive containing surfaces.

In the prior art processes, control and distribution of the adhesive is difficult and inefficient. Some areas of the coil strings may receive too much adhesive while other areas may not receive a sufficient a mount of adhesive. Excess adhesive of course is economically inefficient, while risk of separation of the pocketed coil strings from the nonwoven material may result from too little adhesive. Moreover, when adhesive is spray ed there is a tendency for the spray nozzles to clog so that the flow of glue is obstructed. This results in a time consuming cleaning and maintenance program. Additionally, hot melt spraying requires the system to be heated about one hour before spraying can begin. Other difficulties presented by hot melt spraying and application of beads is that the hoses through which the hot melt flows must be insulated to maintain the temperature of the glue within the hose, thereby resulting in very heavy hoses. If the spraying process involves manually moving the spray nozzle to which the hose is attached to spray the adhesive, the heavy hoses result in the process being slow and fatiguing to the operators who often encounter minor burns from the glue and the nozzles.

A potential solution for the above-described disadvantages is disclosed in this inventor's pending U.S. patent application Ser. No. 09/024,536, filed Feb. 17, 1998, now U.S. Pat. No. 6.175,997 and hereby incorporated by reference in its entirety. In that method, the plurality of strings of pocketed coil springs are placed between top and bottom sheets of nonwoven webs of material, each web having a heat activated reinforcement netting. Thus, the strings are attached at their upper and lower surfaces to the sheets of material, rather than on their side surfaces to an adjacent string.

A problem that exists in all of these prior art processes is wear of the pocketing material at the points at which the coils in adjacent strings rub together. Over time, a hole is worn in the pocketing material, resulting in the metal coils rubbing together. The metal on metal rubbing creates undesirable noise when the mattress is in use. Breckel U.S. Pat. No. 4,907,309 provides a connecting wall made of elastic material between the strings of pocketed coil springs, with the wall being adhesively bonded to the strings. Although this reduces wear of the encasing material, an adhesive must still be manually applied to attach the strings to each other and the elastic material adds complexity and cost to the system and potentially reduces the firmness of the spring assembly.

SUMMARY OF THE INVENTION

The present invention provides a spring core, and a method for making the same, having a layer of preferably flexible, reinforcing material which may or may not include an adhesive component between strings of pocketed coil springs, thus serving to adhere the strings to each other while reducing or preventing wear between coils in frictional relation. According to the principles of the present invention, the reinforcing layer may be added to one or both sides of the pocketing material during the encasing process. After the strings of pocketed coil springs are assembled in side-by-side relation, the adhesive component of the reinforcing material is activated, thereby bonding the strings together. A feasible and economic method for adhering strings of pocketed coil springs together in a spring core assembly is provided while simultaneously reinforcing the pockets of the coil springs to prevent wear between coils of adjacent strings.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
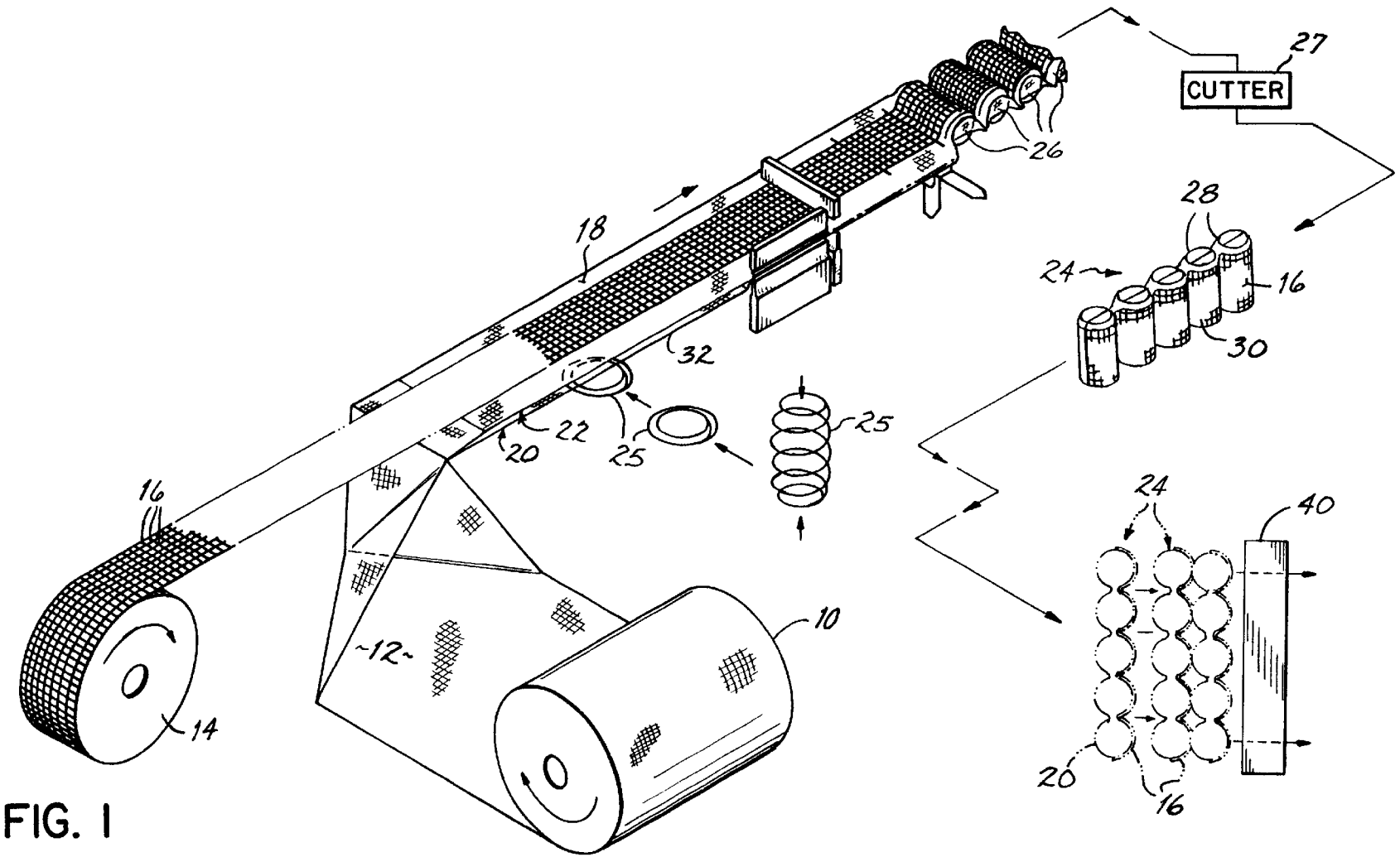
FIG. 1 is a perspective view of a schematic representation of one presently preferred method of the present invention for producing core assemblies consisting of strings of pocketed coil springs with a reinforcing adhesive layer.
Figure 2:
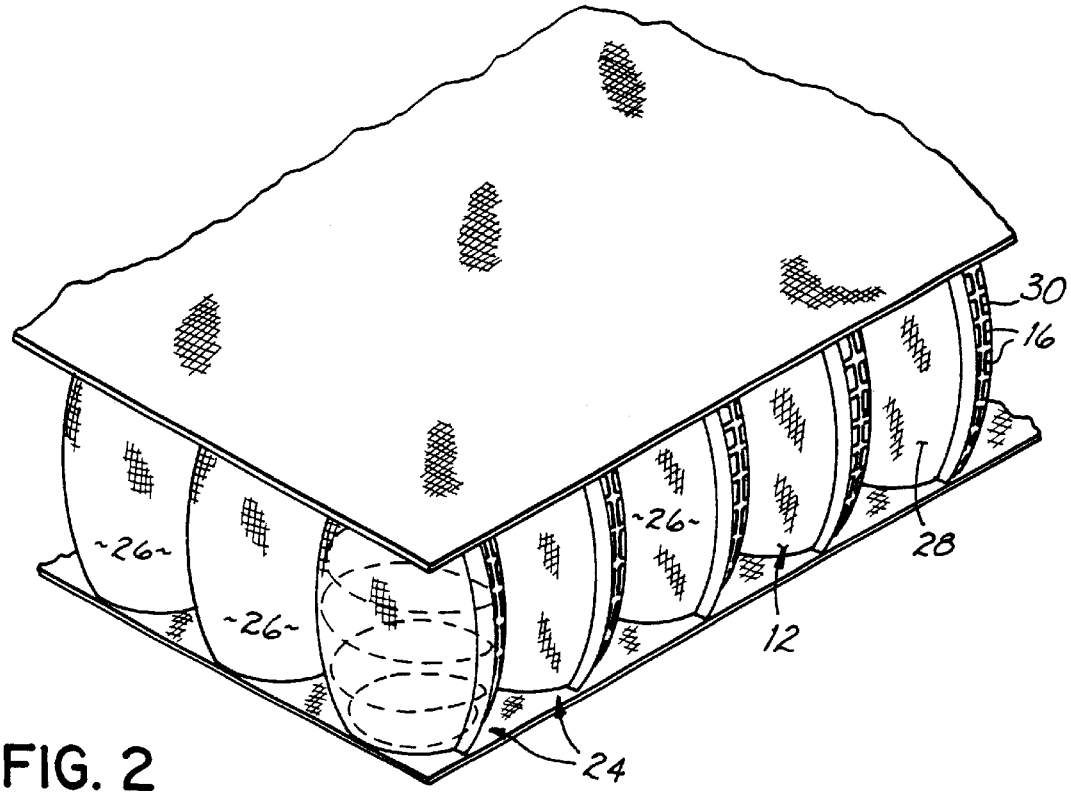
FIG. 2 is a perspective view of a product made by the method of the present invention.
Figure 3:
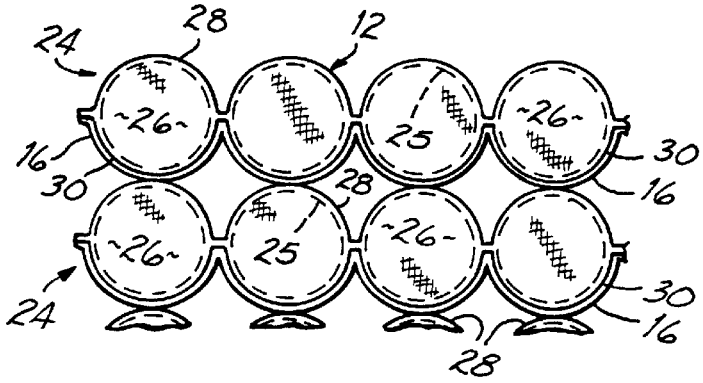
FIG. 3 is a top plan view of a core assembly according to the principles of the present invention.

Referring to the drawings, FIG. 1 illustrates a presently preferred method of manufacturing reinforced pocketed coil springs into strings which may be assembled into cores for use in mattresses or the like according to the principles of the present invention. As illustrated, there is a first supply roll 10 about which a flexible, pocketing material 12 is disposed and a second supply roll 14 about which a preferably flexible reinforcing, adhesive material 16 is disposed. The process is carried out as described above with respect to the prior art, but a layer of flexible, reinforcing, adhesive material 16 is laid upon the outer surface 18 of one of the folds 20, 22 of the pocketing material 12. The resulting string 24 of encased coil springs 26, as shown in FIGS. 2 and 3, has on a first side 28 a layer of pocketing material 12, and on a second opposing side 30 a layer of reinforcing, adhesive material 16 over a layer of pocketing material 12. To form the mattress core, the encased coil springs 26 are cut by a cutter 27 into strings 24 having a desired number of encased coil springs 26, the strings 24 of pocketed coil springs 26 are aligned in columns with the coils 25 side by side, as shown in FIGS. 1, 2 and 3, or in a honeycomb alignment (not shown), with the second side 30 of one string 24 contacting the first side 28 of the adjacent string 24. Thus, between the rows of coil springs 25 there are two layers of pocketing material 12 and an intervening layer of flexible, reinforcing material 16. Heat or other activating means 40 is then applied to the assembly to activate the adhesive component of the reinforcing, adhesive material 16. An adhesive bond is thereby created between the first and second sides 28, 30 of adjacent strings 24.

The reinforcing, adhesive material 16 may be any material with a preprinted pattern of an adhesive, such as glue, or may be a material saturated with an adhesive, or may be a material with an adhesive powder that impregnates the fabric. By way of example, the reinforcing, adhesive material 16 may be a web of nonwoven fabric material reinforced with a heat sensitive mesh netting. One nonwoven material with the reinforced netting is sold under the registered trademark LAMINET® by Conwed Plastics of Minneapolis, Minn. This product includes both the nonwoven material and the heat-actuated adhesive netting, albeit the reinforced heat-actuated netting itself is also sold by this company under the registered trademark THERMANET®. The heat sensitive reinforced mesh or netting is a polypropylene plastic with the adhesive integral with the netting itself so as to form both a bonding agent and a reinforcement for the nonwoven. Furthermore, the web of adhesive may be in a mesh configuration or another known configuration within the scope of this invention.

The activating means 40 for the adhesive component may be an oven operated at temperatures high enough to melt the adhesive component, but low enough to prevent the reinforcing material and pocketing material 12 from melting or burning. For example, the adhesive web on the LAMINET® product has a tack temperature of approximately 180° F. to 212° F. and a melt temperature between 200° F. and 284° F. Thus, the oven may be operated at a temperature of about 225° F. to effectively activate the adhesive component for bonding to the adjacent string of pocketed spring coils. Alternatively, the activating means 40 may be a heat lamp or a radiation emitting device.

Use of a preferably inexpensive reinforcing material between the strings of the pocketed coil springs additionally allows for a less expensive material to be used as the pocketing material, thus lowering the overall cost for producing a complete core assembly. The flexible, reinforcing material may be the reinforcing, adhesive material discussed above, and shown in FIG. 1, or may be a nonadhesive material. In the case of a nonadhesive material, which could be the same material used for the pocketing material, other methods for joining the strings of pocketed coil springs together may be used, such as that described in applicant's pending U.S. application Ser. No. 09/024,536. In either case, a cost savings may be realized for assembling a core that is superior to previous core assemblies.

In an alternative embodiment of the present invention (not shown), a third supply roll about which is disposed flexible, reinforcing, adhesive material 16 is added to the system of FIG. 1, and the reinforcing, adhesive material 16 is applied to the outer surface 32 of the opposite fold 22 of pocketing material 12 as that from the second supply roll 14. Thus, both the first and second sides 28, 30 of the strings 24 of pocketed coil springs 25 have a layer of reinforcing, adhesive material 16 over a pocketing material 12, and between the rows of coil springs 25 there are two layers of pocketing material 12 and two intervening layers of flexible, reinforcing material 16.

Figure 4:
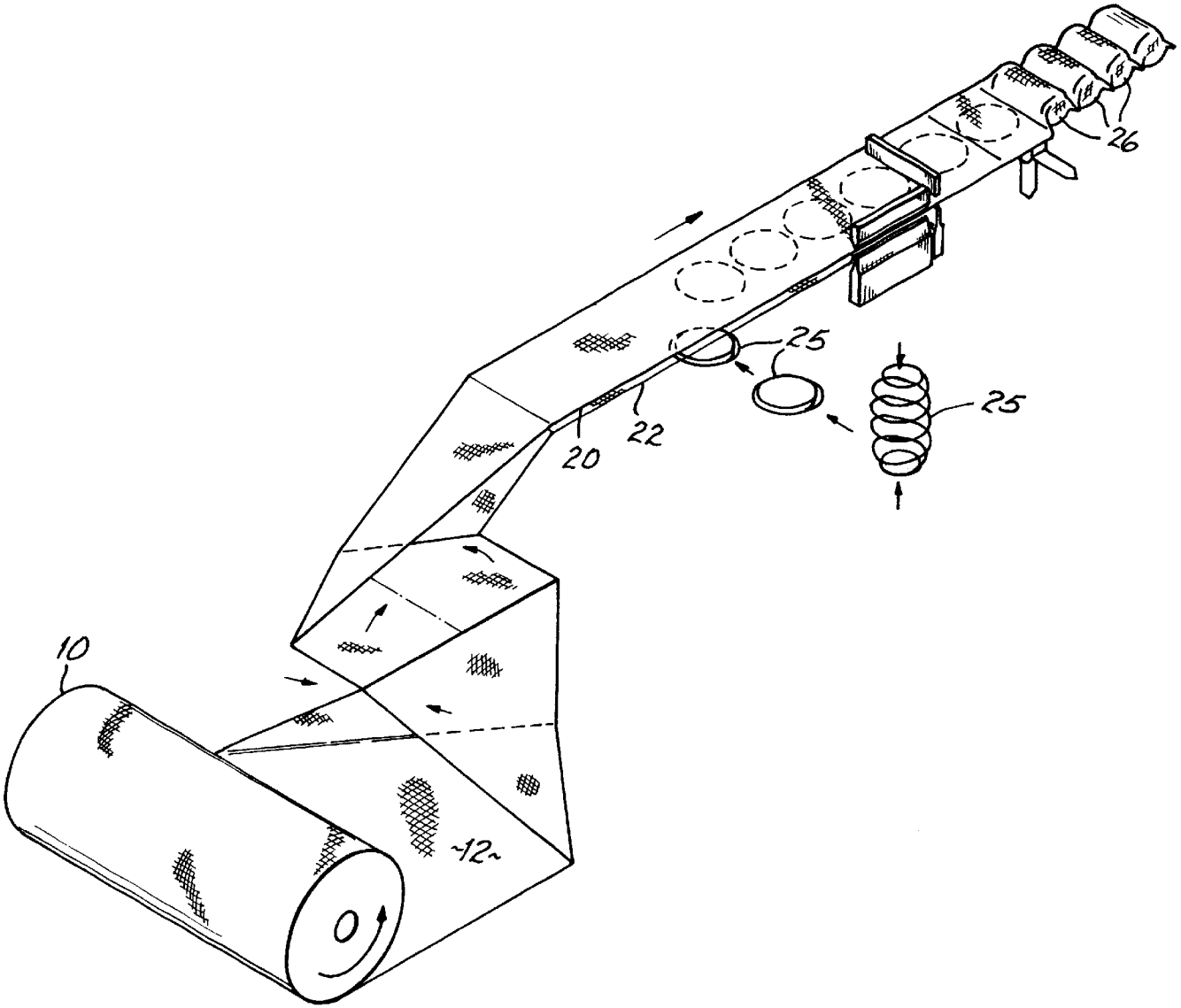
FIG. 4 is a perspective view of a schematic representation of an alternative method of the present invention for producing strings of pocketed coil springs with a reinforcing layer.

In another alternative embodiment of the present invention, shown in FIG. 4, the pocketing material 12 is folded to have three plies, instead of two, such that after the coils 25 are inserted the first side 20 has a single layer of material 12 and the second side 22 has a double layer of material 12. This provides the needed reinforcement between the coils in adjacent strings in a manner that is cost effective. This also eliminates the need for a second supply roll to be added to the equipment for providing the reinforcing material. The top and bottom sheets of adhesive material as described in the applicant's pending U.S. application Ser. No. 09/024,536 could then be used to join the strings of pocketed coil springs together, as could other prior art methods described herein or known to those skilled in the art.

Accordingly, the present invention provides a simple process that overcomes all of the aforesaid problems encountered in the prior art, and does so with reduced costs. The strings are adhered to one another by the adhesive component of the reinforcing, adhesive material without the difficulties of the prior art methods, and wear between coil springs is reduced or eliminated by the addition of the extra layer(s) of fabric. Alternatively, a nonadhesive reinforcement is provided to reduce wear in a cost effective manner in conjunction with known prior methods for adhering the strings together.

Numerous alterations of the structure and process herein disclosed will suggest themselves to those skilled in the art. However, it is to be understood that the present disclosure relates to the preferred embodiments of the invention which are for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of making a spring core comprising:

encasing a plurality of coiled springs in individual pockets of material to form a string of pocketed coil springs with opposing outwardly facing surfaces;

adding a layer of fabric reinforcing material to at least one of the facing surfaces to cover a majority of the area of said facing surface;

juxtaposing a plurality of the strings of pocketed coil springs in side-by-side fashion with longitudinal axes of the springs being generally parallel to one another, and with at least one outwardly facing surface of adjacent strings having the layer of reinforcing material; and joining the strings of pocketed coil springs together.

2. The method as recited in claim 1, wherein the fabric reinforcing material is the same material as the pocket fabric.

3. The method as recited in claim 1, further comprising:

adding a layer of flexible adhesive material between adjacent strings of pocketed coil springs.

4. The method as recited in claim 1, wherein the individual pockets of material are formed by folding the material at least twice to form a strip of material having at least three plies; and wherein the plurality of coiled springs are thereafter inserted between two of the three plies to encase the coiled springs in individual pockets.

5. A method of making a spring core comprising:

folding a strip of material at least twice to form a strip of material having at least three plies;

thereafter inserting each of a plurality of coiled springs between two of the three plies to encase the coiled springs in individual pockets of material to form a string of pocketed coil springs with opposing outwardly facing surfaces;

juxtaposing a plurality of the strings of pocketed coil springs in side-by-side fashion with longitudinal axes of the springs being generally parallel to one another, and with one outwardly facing surface of adjacent strings having the two-ply layer of material and the other outwardly facing surface having the one-ply layer of material, and with at least one outwardly facing surface of adjacent strings having a layer of flexible adhesive material; and joining the strings of pocketed coil springs together.

6. A method of making a spring core comprising:

encasing a plurality of coiled springs in individual fabric pockets to form a string of pocketed coil springs with opposing outwardly facing surfaces;

adding a layer of flexible, fabric reinforcing material to at least one of the facing surfaces, wherein the layer of flexible, fabric reinforcing material has an adhesive component;

juxtaposing a plurality of the strings of pocketed coil springs in side-by-side fashion with longitudinal axes of the springs being generally parallel to one another, and with at least one outwardly facing surface of adjacent strings having the layer of flexible, fabric reinforcing material with the adhesive component; and thereafter activating the adhesive component and thereby joining the strings of pocketed coil springs together.

7. The method as recited in claim 6, further comprising:

inserting the coiled springs in a compressed state through an opening between two plies of fabric;

sealing the fabric between adjacent coils and at the opening to form individual coil-spring containing fabric pockets; and turning the coils to permit expansion along the seal between adjacent pockets.

8. The method as recited in claim 7, wherein the fabric is sealed by stitching.

9. The method as recited in claim 7, wherein the fabric is sealed by thermal sealing.

10. The method as recited in claim 6, wherein the flexible, fabric reinforcing material is a web of nonwoven fabric with a preprinted pattern of a heat activated adhesive on at least one surface.

11. The method as recited in claim 10, wherein the adhesive component is activated by heating the strings of pocketed coil springs.

12. The method as recited in claim 6, wherein the flexible, fabric reinforcing material is a fabric saturated with an adhesive.

13. The method as recited in claim 6, wherein the flexible, fabric reinforcing material is a fabric impregnated with an adhesive powder.

14. A method of making a spring core comprising:

inserting a plurality of coiled springs in a compressed state through an opening between two plies of fabric;

sealing the fabric between adjacent coils and at the opening to form individual coil-spring containing fabric pockets with opposing outwardly facing surfaces, wherein the seal if formed by a method selected from the group comprising stitching and thermal sealing;

turning the coils to permit expansion along the seal between adjacent pockets;

adding a layer of flexible, fabric reinforcing material to at least one of the facing surfaces, wherein the layer of flexible, fabric reinforcing material has an adhesive component;

juxtaposing a plurality of the strings of pocketed coil springs in side-by-side fashion with longitudinal axes of the springs being generally parallel to one another, and with at least one outwardly facing surface of adjacent strings having the layer of flexible, fabric reinforcing material with the adhesive component; and activating the adhesive component and thereby joining the strings of pocketed coil springs together.

15. A method of making a spring core comprising:

encasing a plurality of coiled springs in individual fabric pockets to form a string of pocketed coil springs;

juxtaposing a plurality of the strings of pocketed coil springs in side-by-side fashion with longitudinal axes of the springs being generally parallel to one another;

adding a layer of flexible, fabric reinforcing material between adjacent strings of pocketed coil springs, the flexible, fabric reinforcing material having an adhesive component; and thereafter activating the adhesive component and thereby joining the strings of pocketed coil springs together.

16. The method as recited in claim 15, further comprising:

inserting the coiled springs in a compressed state through an opening between two plies of fabric;

sealing the fabric between adjacent coils and at the opening to form individual coil-spring containing fabric pockets; and turning the coils to permit expansion along the seal between adjacent pockets.

17. The method as recited in claim 16, wherein the fabric is sealed by stitching.

18. The method as recited in claim 16, wherein the fabric is sealed by thermal sealing.

19. The method as recited in claim 15, wherein the flexible, fabric reinforcing material is a web of nonwoven fabric with a preprinted pattern of a heat activated adhesive on at least one surface.

20. The method as recited in claim 19, wherein the adhesive component is activated by heating the strings of pocketed coil springs.

21. The method as recited in claim 15, wherein the flexible, fabric reinforcing material is a fabric saturated with an adhesive.

22. The method as recited in claim 15, wherein the flexible, fabric reinforcing material is a fabric impregnated with an adhesive powder.

23. A spring core comprising:

a plurality of strings of coiled springs in individual fabric pockets in side by side relation with longitudinal axes of the springs being generally parallel to one another; and a layer of flexible fabric material with an adhesive component between each adjacent pair of strings of coiled springs, and covering a major portion of each facing surface of the adjacent strings, the adhesive having been activated to bond the adjacent strings together.

24. The spring core of claim 23, wherein the flexible fabric material is a web of nonwoven fabric reinforced with an adhesive netting on at least one surface.

25. The spring core of claim 23, wherein the adhesive netting is polypropylene with adhesive integral with the netting.

26. A spring core comprising:

a plurality of strings of coiled springs in individual fabric pockets in side by side relation with longitudinal axes of the springs being generally parallel to one another; wherein the individual fabric pockets are two-ply on a first side, one-ply on a second side, and sealed at one longitudinal end; and a layer of adhesive material between each adjacent pair of strings of coiled springs bonding the adjacent strings together.

27. A spring assembly manufactured from a method comprising:

encasing a plurality of coiled springs in individual fabric pockets to form a string of pocketed coil springs with opposing outwardly facing surfaces;

adding a layer of flexible, fabric reinforcing material to at least one of the facing surfaces, wherein the layer of flexible, fabric reinforcing material has an adhesive component;

juxtaposing a plurality of the strings of pocketed coil springs in side-by-side fashion with longitudinal axes of the springs being generally parallel to one another, and with at least one outwardly facing surface of adjacent strings having the layer of flexible, fabric reinforcing material with the adhesive component; and thereafter activating the adhesive component and thereby joining the strings of pocketed coil springs together.

28. The spring assembly of claim 27 manufactured by the method further comprising:

encasing the coiled springs in a compressed state; and turning the coiled springs to allow the springs to expand.

29. A spring assembly manufactured from a method comprising:

folding a strip of material at least twice to form a strip of material having at least three plies;

thereafter inserting each of a plurality of coiled springs between two of the three plies to encase the coiled springs in individual pockets of material to form a string of pocketed coil springs with opposing outwardly facing surfaces;

adding a layer of flexible adhesive material to at least one of the facing surfaces;

juxtaposing a plurality of the strings of pocketed coil springs in side-by-side fashion with longitudinal axes of the springs being generally parallel to one another, and with one outwardly facing surface of adjacent strings having the two-ply layer of material and the other outwardly facing surface having the one-ply layer of material, and with at least one outwardly facing surface of adjacent strings having the layer of flexible adhesive material; and joining the strings of pocketed coil springs together.

30. A method of making a spring core comprising:

encasing a plurality of coiled springs in pocketing material to form a string of pocketed coil springs with opposing outwardly facing surfaces;

adding a layer of fabric material to at least one of the facing surfaces to cover a majority of the area of said facing surface;

juxtaposing a plurality of the strings of pocketed coil springs in side-by-side fashion with longitudinal axes of the springs being generally parallel to one another, and with at least one outwardly facing surface of adjacent strings having the layer of fabric material; and joining the strings of pocketed coil springs together.

31. The method of claim 30 wherein the strings are joined adhesively with the layer of fabric material.

32. A method of making a spring core comprising:

encasing a plurality of coiled springs in pocketing material to form a string of pocketed coil springs with opposing outwardly facing surfaces;

adding a discrete layer of fabric material to at least one of the facing surfaces of the pocketing material;

juxtaposing a plurality of the strings of pocketed coil springs in side-by-side fashion with longitudinal axes of the springs being generally parallel to one another, and with at least one outwardly facing surface of adjacent strings having the layer of fabric material; and joining the strings of pocketed coil springs together.

33. The method of claim 32 wherein the strings are joined adhesively with the layer of fabric material.

34. A spring core comprising:

a plurality of strings of coiled springs in pockets in side by side relation with longitudinal axes of the springs being generally parallel to one another; and a layer of fabric material adhesively joined between each adjacent pair of strings of coiled springs, and covering a majority of the area of each facing surface of the adjacent strings, wherein the adjacent strings are joined together by adhesive.

35. A spring core comprising:

a plurality of strings of coiled springs in pockets formed from pocketing material in side by side relation with longitudinal axes of the springs being generally parallel to one another; and a discrete layer of fabric material adhesively joined between each adjacent pair of strings of coiled springs, wherein the adjacent strings are joined together by adhesive.

* * * * *

UNITED STATES PATENT AND TRADEMARK OFFICE

CERTIFICATE OF CORRECTION

PATENT NO. : 6,295,673 B1
DATED : October 2, 2001
INVENTOR(S) : Niels S. Mossbeck It is certified that error appears in the above-identified patent and that said Letters Patent is hereby corrected as shown below:

Column 1,
Line 22, "scaled" should read -- sealed --.
Lines 40-41, "4,578,834 5,016,305 and 5,637,178," should read -- 4,578,834, and Suenens et al. 5,016,305 and 5,637,178, --.
Line 60, "a mount of" should read -- amount of --.
Line 64, "is spray ed there" should read -- is sprayed there --.

Column 6,
Line 27, "if formed" should read -- is formed --.

Signed and Sealed this

Twenty-sixth Day of March, 2002

*Attest:*

*Attesting Officer*

JAMES E. ROGAN
*Director of the United States Patent and Trademark Office*